US009193545B1

(12) United States Patent
Hsieh et al.

(10) Patent No.: US 9,193,545 B1
(45) Date of Patent: Nov. 24, 2015

(54) SEPARATION FUNCTION RELEASING MECHANISM

(71) Applicant: Foxlink Image Technology Co. Ltd., New Taipei (TW)

(72) Inventors: Wei Pin Hsieh, New Taipei (TW); Yung Kai Chen, New Taipei (TW)

(73) Assignee: FOXLINK IMAGE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/317,263

(22) Filed: Jun. 27, 2014

(51) Int. Cl.
*B65H 3/52* (2006.01)
*B65H 3/06* (2006.01)
*B65H 5/06* (2006.01)

(52) U.S. Cl.
CPC ..... *B65H 3/0684* (2013.01); *B65H 5/068* (2013.01)

(58) Field of Classification Search
CPC .. B65H 3/5246; B65H 3/5253; B65H 3/0684; B65H 5/068
USPC ..... 271/125, 121, 122, 272–274
See application file for complete search history.

(56) References Cited

U.S. PATENT DOCUMENTS

| | | | | |
|---|---|---|---|---|
| 2,922,643 | A * | 1/1960 | Lopez | 271/35 |
| 3,991,998 | A * | 11/1976 | Banz et al. | 271/125 |
| 5,203,846 | A * | 4/1993 | Kuhns et al. | 271/125 |
| 5,244,197 | A * | 9/1993 | Helmstadter | 271/35 |
| 6,485,012 | B1 * | 11/2002 | Bakoledis | 271/35 |
| 7,722,028 | B2 * | 5/2010 | Bitner | 271/35 |
| 8,132,809 | B2 * | 3/2012 | Shiraishi et al. | 271/162 |

* cited by examiner

*Primary Examiner* — Thomas Morrison
(74) *Attorney, Agent, or Firm* — Muncy, Geissler, Olds & Lowe, P.C.

(57) ABSTRACT

A separation function releasing mechanism includes a frame defining two activating slots at two opposite sides, a separating mechanism which includes a bracket pivoted to the frame and a group of retard rollers rotatably mounted to the frame, a group of separating rollers located under the retard rollers, and a pushing mechanism which includes a connecting element mounted in one side of the frame and capable of sliding forward and backward. Two opposite sides of the bracket protrude outward to form a pair of activating columns slidably located in the activating slots with the distal ends projecting outward out of the activating slots. A top face of a rear of the connecting element is defined as a slantwise pushing plane and a horizontal blocking plane in front of the pushing plane which are located under and in front of the activating column to work closely with the activating column.

4 Claims, 5 Drawing Sheets

SEPARATION FUNCTION RELEASING MECHANISM

BACKGROUND OF THE INVENTION

1. Field of the Invention

The present invention relates to a separation mechanism, and more particularly to a separation function releasing mechanism.

2. the Related Art

A traditional separation mechanism includes a frame, a group of separating rollers and a group of retard rollers. The separating rollers and the retard rollers are mounted to the frame and have a constant distance. When scanning happened to get folded document, thicker document, embossed document, documents adhered with paster or picture, or other documents not easy to separate, the foregoing document is apt to be offset or scratched by the friction of the retard rollers because of the constant distance between the separating rollers and the retard rollers. Therefore, it is preferable to have a new design to resolve the above scanning problem.

SUMMARY OF THE INVENTION

Accordingly, an object of the present invention is to provide a separation function releasing mechanism mounted to an image scanning equipment. The separation function releasing mechanism includes a frame, a separating mechanism, a group of separating rollers and a pushing mechanism. A bottom face of the frame is concaved upward to form a bracket cavity. Two side walls of the bracket cavity define a pair of activating slots each penetrating through two opposite sides and extending vertically through a bottom edge thereof. The separating mechanism includes a bracket, a fastening shaft fastened on the bracket and a group of retard rollers rotatably worn on the fastening shaft. A rear of the bracket is pivoted to the frame with the separating mechanism being located in the bracket cavity of the frame and capable of swinging up and down. Two opposite sides of a front of the bracket protrude outward to form a pair of activating columns which are slidably located in the activating slots of the frame. The distal ends of the activating columns project outward out of the activating slots. The separating rollers are mounted to the image scanning equipment under the retard rollers and drive the retard rollers to rotate by friction. The pushing mechanism includes a connecting element mounted in one side of the frame and capable of sliding forward and backward by external force. A top face of a rear of the connecting element is defined as a slantwise pushing plane and a horizontal blocking plane in front of the pushing plane. The pushing plane and the blocking plane of the pushing mechanism are located under and in front of the activating column of the bracket of the separating mechanism.

As described above, the embodiment of the invention of the separation function releasing mechanism utilizes the cooperation between the pushing plane of the connecting element and the activating column of the bracket which is realized by the backward and forward slide of the connecting element to drive the separating mechanism to swing up and down, and then utilizes the up and down swing of the separating mechanism to adjust a distance between the retard rollers and the separating rollers so as to ensure the scanning document can smoothly pass through the distance between the retard rollers and the separating rollers and avoid the scanning document being damaged.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
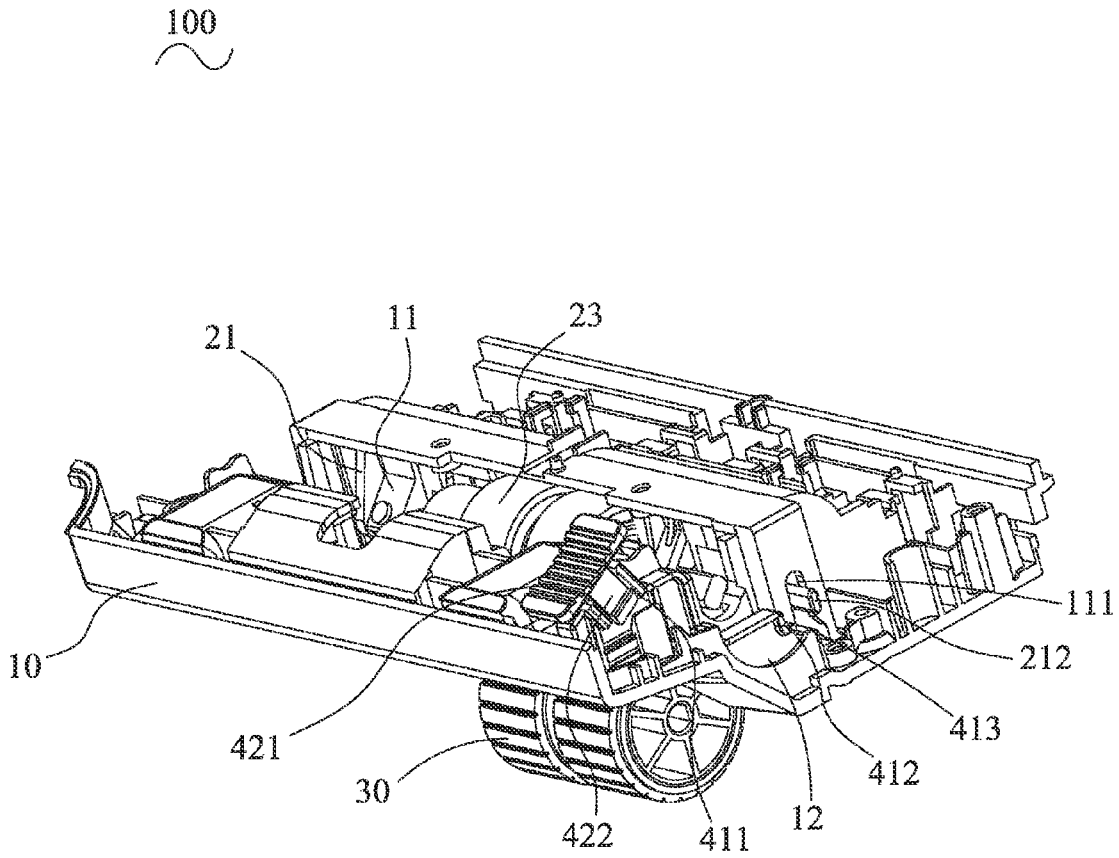
FIG. 1 is an assembled, perspective view of a separation function releasing mechanism in accordance with an embodiment of the present invention.

Referring to the drawings in greater detail, and first to FIG. 1, an embodiment of the present invention is embodied in a separation function releasing mechanism 100 mounted to an image scanning equipment (not shown). The separation function releasing mechanism 100 includes a frame 10, a separating mechanism 20, a group of separating rollers 30 and a pushing mechanism 40.

The frame 10 is an integral structure. A bottom face of the frame 10 is concaved upward to form a bracket cavity 11 for receiving the separating mechanism 20 therein. Two side walls of the bracket cavity 11 define a pair of activating slots 111 each penetrating through two opposite sides and extending vertically through a bottom edge thereof. Two opposite sides of a rear of the bracket cavity 11 define a pair of fastening slots (not shown). One side of a top face of the frame 10 is concaved downward to form a sliding slot 12 of which a rear is communicated with a bottom of the activating slot 111.

Figure 2:
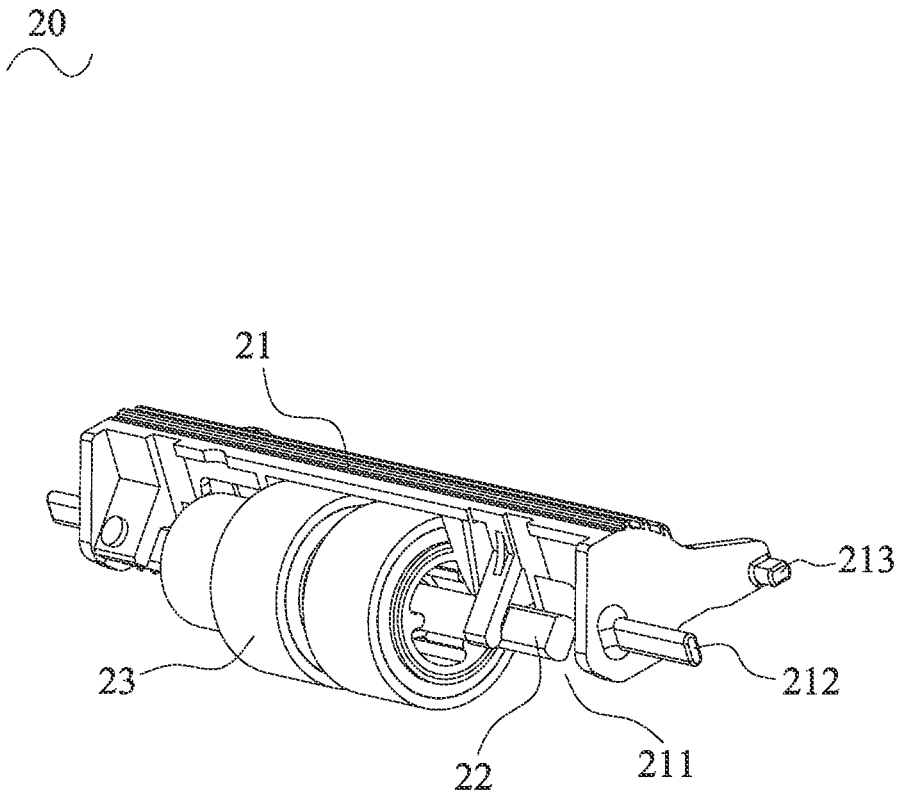
FIG. 2 is an assembled, perspective view of a separating mechanism of the separation function releasing mechanism shown in FIG. 1.

Referring to FIG. 2, the separating mechanism 20 includes a bracket 21, a fastening shaft 22 fastened on the bracket 21 and a group of retard rollers 23 rotatably worn on the fastening shaft 22. A rear of the bracket 21 is pivoted to the frame 10 with the separating mechanism 20 being located in the bracket cavity 11 of the frame 10 and capable of swinging up and down. A bottom face of the bracket 21 is concaved upward to form a receiving cavity 211. The fastening shaft 22 and the retard rollers 23 are received in the receiving cavity 211. Two opposite sides of the rear of the bracket 21 extend rearward and then protrude outward to form a pair of fastening columns 213. The fastening columns 213 of the bracket 21 are pivoted in the fastening slots of the frame 10. Two opposite sides of a front of the bracket 21 protrude outward to form a pair of activating columns 212 which are slidably located in the activating slots 111 of the frame 10. The distal ends of the activating columns 212 project outward out of the activating slots 111. The separating rollers 30 are mounted to the image scanning equipment under the retard rollers 23 and drive the retard rollers 23 to rotate by friction.

Figure 3:
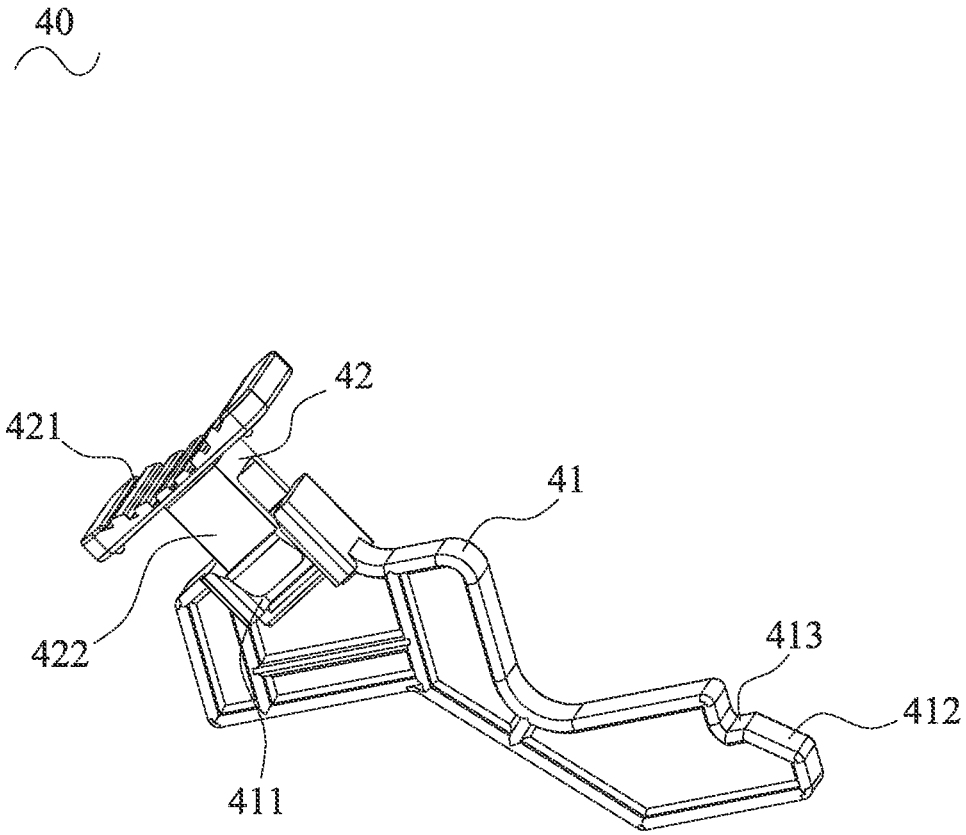
FIG. 3 is an assembled, perspective view of a pushing mechanism of the separation function releasing mechanism shown in FIG. 1.

Referring to FIG. 3, the pushing mechanism 40 includes a connecting element 41 mounted in one side of the frame 10 and capable of sliding forward and backward by external force. In detail, the connecting element 41 of the pushing mechanism 40 is slidably located in the sliding slot 12 of the frame 10. Two opposite sides of a front top of the connecting element 41 are concaved inward to form a pair of buckling slots 411. A top face of a rear of the connecting element 41 is defined as a slantwise pushing plane 412 and a horizontal blocking plane 413 in front of the pushing plane 412. The pushing plane 412 and the blocking plane 413 of the pushing mechanism 40 are located under and in front of the activating column 212 of the bracket 21 of the separating mechanism 20. The pushing mechanism 40 further includes a pushing element 42 which has a pushing portion 421. Two opposite sides of a bottom of the pushing portion 421 protrude downward to form a pair of buckling portions 422 corresponding to the buckling slots 411 of the connecting element 41. The pushing element 42 is mounted on the front top of the connecting element 41 and can slantwise slide up and down by the buckling portions 422 being slidably buckled in the buckling slots 411. The pushing element 42 further projects upward outside the frame 10 for driving the connecting element 41 to slide forward and backward.

Figure 5:
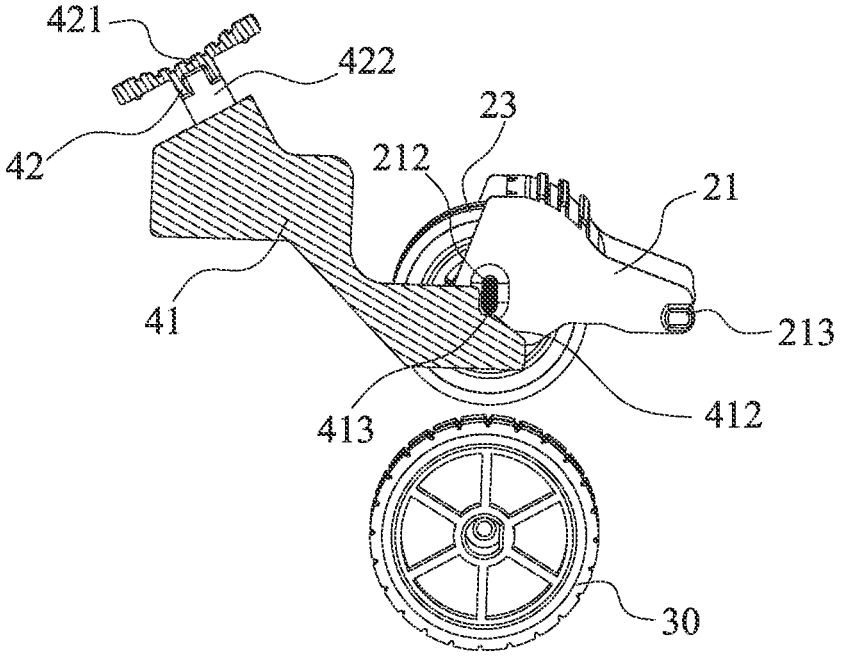
FIG. 5 is a cross-sectional view showing that the retard roller of the separating mechanism is separated from the separating roller of the separation function releasing mechanism shown in FIG. 1.

Referring to FIG. 5, in use of scanning folded document, thicker document, embossed document, document adhered with paster or picture, or other documents not easy to separate, push the pushing portion 421 of the pushing element 42 rearward to push the connecting element 41 rearward, so that the activating column 212 of the bracket 21 slides up along the pushing plane 412 to drive the retard rollers 23 to swing upward until the activating column 212 is blocked on the blocking plane 413 of the connecting element 41 of the pushing mechanism 40, so as to make the retard rollers 23 of the separating mechanism 20 far away from the separating rollers 30 and ensure the scanning document smoothly through the distance between the retard rollers 23 and the separating rollers 30.

Figure 4:
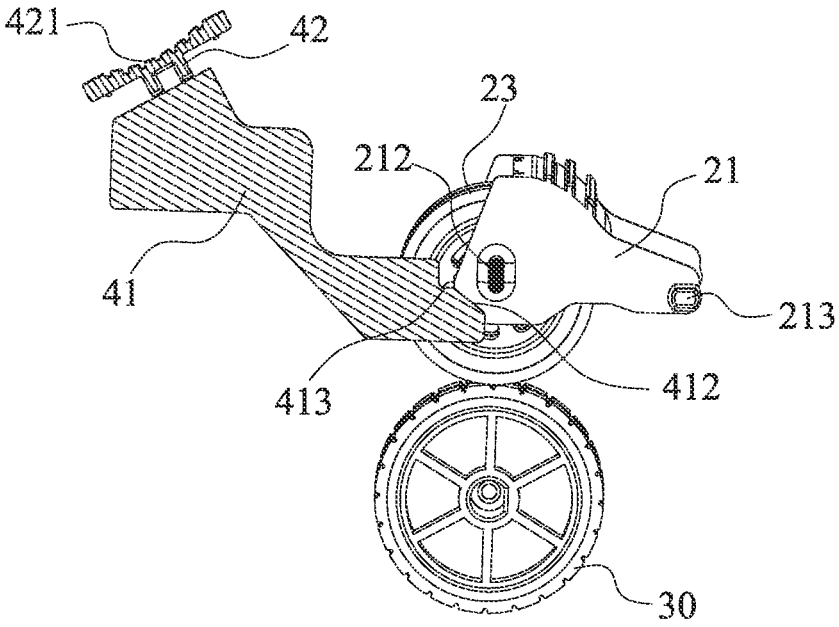
FIG. 4 is a cross-sectional view showing that a separating roller of the separation function releasing mechanism of FIG. 1 is acted on a retard roller of the separating mechanism of FIG. 2.

Referring to FIG. 4, in use of scanning normal documents, pull the pushing portion 421 of the pushing element 42 frontward to pull the connecting element 41 frontward, so that the activating column 212 of the bracket 21 slides down along the pushing plane 412 of the connecting element 41 of the pushing mechanism 40 to drive the retard rollers 23 to swing downward, so as to make the retard rollers 23 of the separating mechanism 20 contact with the separating rollers 30 and realize the rotation of the retard rollers 23 by virtue of the friction of the separating rollers 30.

Another embodiment of the present invention is embodied in a separation function releasing mechanism 100 having a substantially same structure as the one in the embodiment above mentioned. The difference is the pushing mechanism 40 includes the connecting element 41 and a deflecting element (not shown) rotatably mounted to the side wall of the activating slot 111 of the frame 10. One end of the deflecting element is flexibly connected to the connecting element 41, and the other end of the deflecting element projects upward beyond the top face of the frame 10.

In use of scanning folded document, thicker document, embossed document, document adhered with paster or picture, or other documents not easy to separate, pull the deflecting element projecting out of the frame 10 frontward to drive the connecting element 41 rearward, so that the activating column 212 of the bracket 21 slides up along the pushing plane 412 to drive the retard rollers 23 to swing upward until the activating column 212 is blocked on the blocking plane 413 of the connecting element 41 of the pushing mechanism 40, so as to make the retard rollers 23 of the separating mechanism 20 far away from the separating rollers 30 and ensure the scanning document smoothly through the distance between the retard rollers 23 and the separating rollers 30.

In use of scanning normal documents, push the deflecting element projecting out of the frame 10 rearward to drive the connecting element 41 frontward, so that the activating column 212 of the bracket 21 slides down along the pushing plane 412 of the connecting element 41 of the pushing mechanism 40 to drive the retard rollers 23 to swing downward, so as to make the retard rollers 23 of the separating mechanism 20 contact with the separating rollers 30 and realize the rotation of the retard rollers 23 by virtue of the friction of the separating rollers 30.

As described above, the embodiment of the invention of the separation function releasing mechanism 100 utilizes the cooperation between the pushing plane 412 of the connecting element 41 and the activating column 212 of the bracket 21 which is realized by the backward and forward slide of the connecting element 41 to drive the separating mechanism 20 to swing up and down, and then utilizes the up and down swing of the separating mechanism 20 to adjust a distance between the retard rollers 23 and the separating rollers 30 so as to ensure the scanning document can smoothly pass through the distance between the retard rollers 23 and the separating rollers 30 and avoid the scanning document being damaged.

What is claimed is:

1. A separation function releasing mechanism mounted to an image scanning equipment, comprising:

a frame, a bottom face of the frame being concaved upward to form a bracket cavity, two side walls of the bracket cavity defining a pair of activating slots each penetrating through two opposite sides and extending vertically through a bottom edge thereof;

a separating mechanism including a bracket, a fastening shaft fastened on the bracket and a group of retard rollers rotatably worn on the fastening shaft, a rear of the bracket being pivoted to the frame with the separating mechanism being located in the bracket cavity of the frame and capable of swinging up and down, two opposite sides of a front of the bracket protruding outward to form a pair of activating columns which are slidably located in the activating slots of the frame, the distal ends of the activating columns projecting outward out of the activating slots;

a group of separating rollers mounted to the image scanning equipment under the retard rollers and driving the retard rollers to rotate by friction; and a pushing mechanism including a connecting element mounted in one side of the frame and capable of sliding forward and backward by external force, a top face of a rear of the connecting element being defined as a slantwise pushing plane and a horizontal blocking plane in front of the pushing plane, the pushing plane and the blocking plane of the pushing mechanism being located under and in front of one of the activating columns of the bracket of the separating mechanism, wherein the cooperation between the pushing plane of the connecting element and the one of the activating columns of the bracket is realized by the backward and forward slide of the connecting element and drives the separating mechanism to swing up and down, and the up and down swing of the separating mechanism further adjusts a distance between the retard rollers and the separating rollers.

2. The separation function releasing mechanism as claimed in claim 1, wherein two opposite sides of a front top of the connecting element are concaved inward to form a pair of buckling slots, the pushing mechanism further includes a pushing element which has a pushing portion, two opposite sides of a bottom of the pushing portion protrude downward to form a pair of buckling portions corresponding to the buckling slots of the connecting element, the pushing element is mounted on the front top of the connecting element and can slantwise slide up and down by the buckling portions being slidably buckled in the buckling slots, the pushing element further projects upward outside the frame for driving the connecting element to slide forward and backward.

3. The separation function releasing mechanism as claimed in claim 1, wherein a bottom face of the bracket is concaved upward to form a receiving cavity, the fastening shaft and the retard rollers are received in the receiving cavity.

4. The separation function releasing mechanism as claimed in claim 1, wherein one side of a top face of the frame is concaved downward to form a sliding slot of which a rear is communicated with a bottom of one of the activating slots, the connecting element of the pushing mechanism is slidably located in the sliding slot.

* * * * *